US009254411B1

(12) United States Patent
Chang

(10) Patent No.: US 9,254,411 B1
(45) Date of Patent: Feb. 9, 2016

(54) TREADMILL WITH ADJUSTABLE SHOCK-ABSORBING STRUCTURE

(71) Applicant: Li-Ling Chang, Taichung (TW)

(72) Inventor: Li-Ling Chang, Taichung (TW)

( * ) Notice: Subject to any disclaimer, the term of this patent is extended or adjusted under 35 U.S.C. 154(b) by 0 days.

(21) Appl. No.: 14/460,412

(22) Filed: Aug. 15, 2014

(51) Int. Cl.
*A63B 22/02* (2006.01)

(52) U.S. Cl.
CPC ..... *A63B 22/02* (2013.01); *A63B 2022/0214* (2013.01)

(58) Field of Classification Search
USPC ..... 482/1–148
See application file for complete search history.

(56) References Cited

U.S. PATENT DOCUMENTS 6,589,138 B2 * 7/2003 Dyer ..... A63B 22/02 482/51
2005/0164839 A1 * 7/2005 Watterson ..... A63B 22/02 482/54
2010/0160115 A1 * 6/2010 Morris ..... A63B 22/0235 482/4

* cited by examiner

*Primary Examiner* — Stephen Crow
(74) *Attorney, Agent, or Firm* — Alan D. Kamrath; Kamrath IP Lawfirm, P.A.

(57) ABSTRACT

A treadmill includes a frame, a support plate mounted on the frame, and a shock-absorbing structure mounted on two opposite sides of the frame. The shock-absorbing structure includes an elastic bar mounted between the frame and the support plate to support the support plate and to provide a shock-absorbing function. The elastic bar is above the frame and under the support plate and has two opposite ends each pivotally mounted between the frame and the support plate. Thus, the elastic bar is movable in a horizontal direction and is elastically bendable toward an inner side or an outer side of the support plate to increase or decrease a contact area of the elastic bar and the support plate and to change the position of the elastic bar relative to the support plate.

6 Claims, 11 Drawing Sheets

TREADMILL WITH ADJUSTABLE SHOCK-ABSORBING STRUCTURE

BACKGROUND OF THE INVENTION

1. Field of the Invention

The present invention relates to a treadmill and, more particularly, to a treadmill with an adjustable shock-absorbing structure.

2. Description of the Related Art

A conventional treadmill in accordance with the prior art shown in FIGS. 1-3 comprises a frame 20, a support plate 21 mounted on and located above the frame 20, a belt 22 mounted around the support plate 21, and a plurality of vibration absorbers 23 mounted between the frame 20 and the support plate 21 by a plurality of bolts 24. Each of the vibration absorbers 23 has a cylindrical shape. In operation, when the user steps on the belt 22, the support plate 21 is subjected to a downward force. At this time, the vibration absorbers 23 apply a reaction to the support plate 21 so as to provide a shock-absorbing function to the support plate 21. However, each of the vibration absorbers 23 has a fixed elasticity that cannot be adjusted according to the user's requirement. In addition, the vibration absorbers 23 are easily deflected and distorted due to an unevenly distributed force applied by the user's downward pressure so that the vibration absorbers 23 are easily worn or torn during a long-term utilization, thereby decreasing the shock-absorbing function.

BRIEF SUMMARY OF THE INVENTION

In accordance with the present invention, there is provided a treadmill comprising a frame, a support plate mounted on the frame, and a shock-absorbing structure mounted on two opposite sides of the frame. The shock-absorbing structure includes an elastic bar mounted between the frame and the support plate to support the support plate and to provide a shock-absorbing function. The elastic bar is located above the frame and located under the support plate and has two opposite ends each pivotally mounted between the frame and the support plate. Thus, the elastic bar is movable in a horizontal direction and is elastically bendable toward an inner side or an outer side of the support plate to increase or decrease a contact area of the elastic bar and the support plate and to change a position of the elastic bar relative to the support plate so as to adjust a shock-absorbing effect of the support plate.

Preferably, the elastic bar is hollow.

In the preferred embodiment of the present invention, the elastic bar is made of rubber, silicon gel or polyurethane (PU).

The shock-absorbing structure further includes a mounting ring mounted on the elastic bar. The mounting ring is mounted on a mediate portion of the elastic bar. The mounting ring is provided with two pull tabs which are directed toward two opposite directions.

The shock-absorbing structure further includes two fixing sleeves mounted on the elastic bar. The fixing sleeves are respectively mounted in the two opposite ends of the elastic bar.

The support plate has two opposite sides each provided with two first through holes, each of the two opposite ends of the elastic bar is provided with a second through hole, each of the fixing sleeves is provided with a third through hole, each of the two opposite sides of the frame is provided with two fourth through holes, and the shock-absorbing structure further includes two pivot members each extended through the respective first through hole of the support plate, the respective second through hole of the elastic bar, the third through hole of the respective fixing sleeve and the respective fourth through hole of the frame, so that each of the two opposite ends of the elastic bar is pivotally mounted between the frame and the support plate.

According to the primary advantage of the present invention, the contact area of the elastic bar and the support plate can be changed freely according to the requirement of users having different weights to adjust the reaction applied by the elastic bar on the support plate, and to adjust the shock-absorbing function of the elastic bar.

According to another advantage of the present invention, when the elastic bar at the two opposite sides of the frame is located at the outer side of the support plate, the central portion of the support plate is disposed at a softer state, and when the elastic bar at the two opposite sides of the frame is located at the inner side of the support plate, the central portion of the support plate is disposed at a harder state, so that the buffering function of the support plate can be changed according to the user's requirement.

According to a further advantage of the present invention, the elastic bar is mounted between the frame and the support plate and is disposed at an exposed state so that the user can easily pull the pull tabs at two opposite sides of the mounting ring so as to change the contact area of the elastic bar and the support plate quickly and conveniently.

According to a further advantage of the present invention, the two opposite ends of the elastic bar are pivotally mounted between the frame and the support plate, and the fixing sleeves are respectively mounted in the two opposite ends of the elastic bar to reinforce the structural strength of the two opposite ends of the elastic bar, thereby preventing the two opposite ends of the elastic bar from being worn or torn due to repeatedly pulling actions during a long-term utilization.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
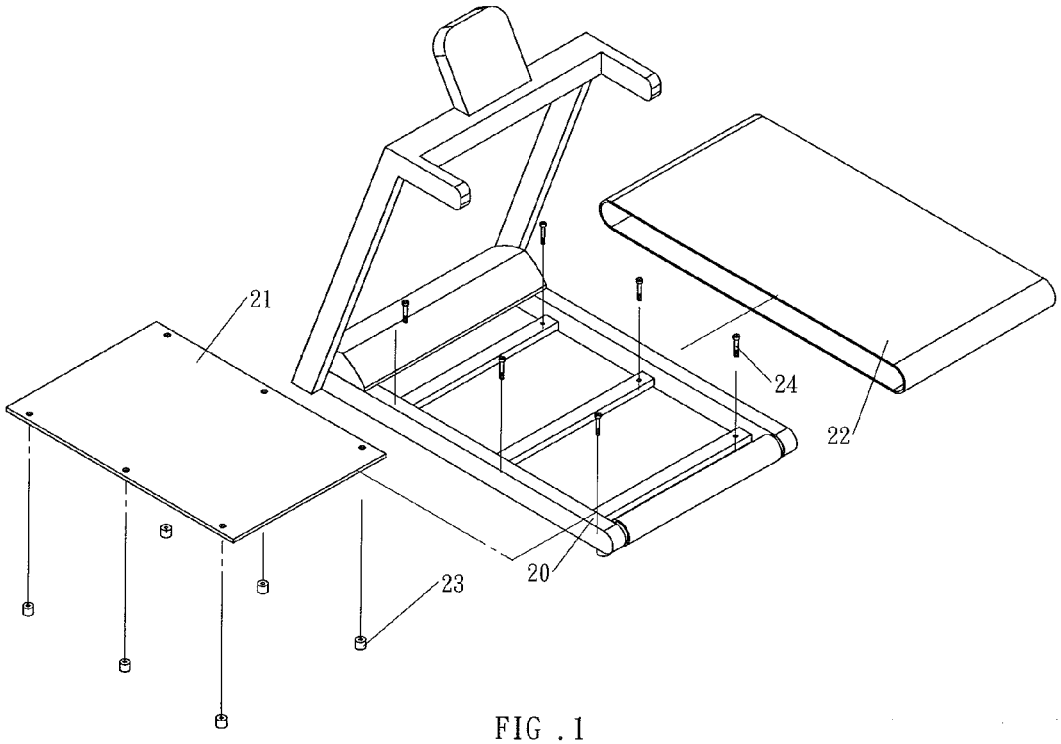
FIG . 1 PRIOR ART
FIG. 1 is an exploded perspective view of a conventional treadmill in accordance with the prior art.
Figure 2:
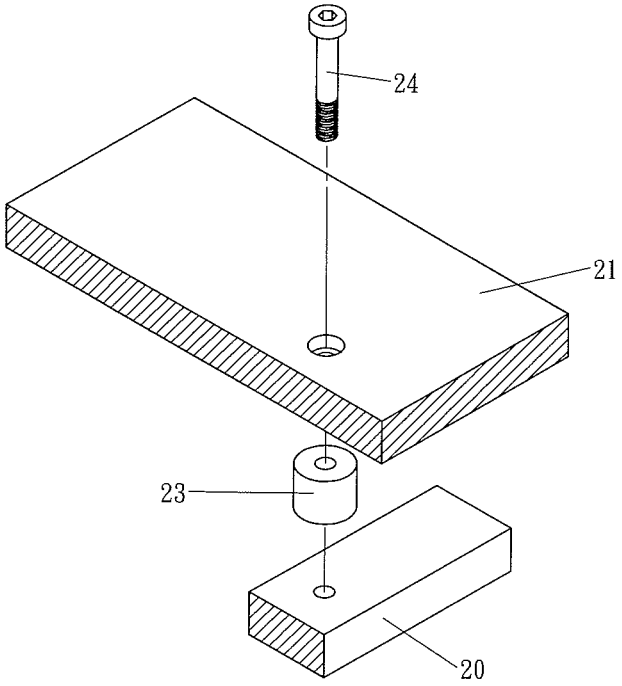
FIG . 2 PRIOR ART
FIG. 2 is a partially enlarged cross-sectional view of the conventional treadmill as shown in FIG. 1.
Figure 3:
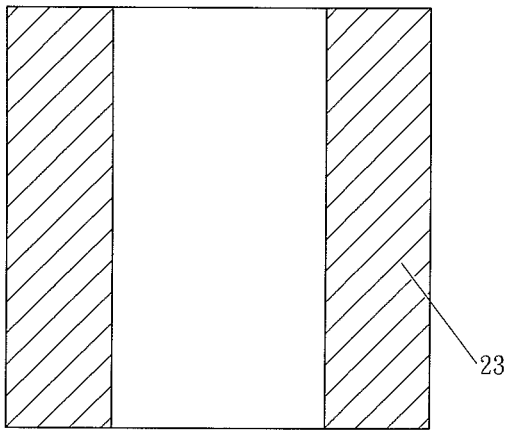
FIG .3 PRIOR ART
FIG. 3 is a front cross-sectional view of a vibration absorber of the conventional treadmill as shown in FIG. 1.
Figure 4:
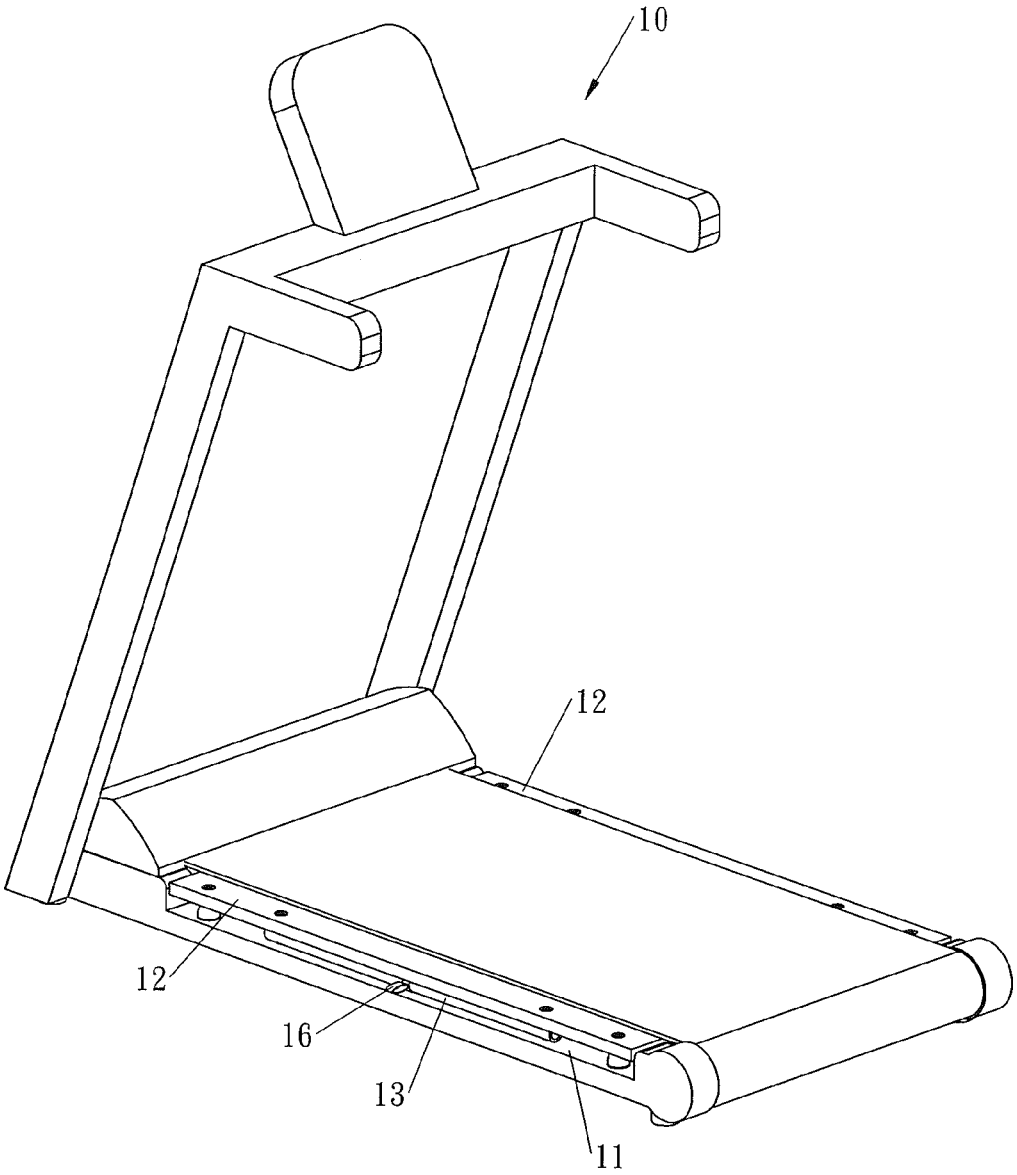
FIG. 4 is a perspective view of a treadmill in accordance with the preferred embodiment of the present invention.
Figure 5:
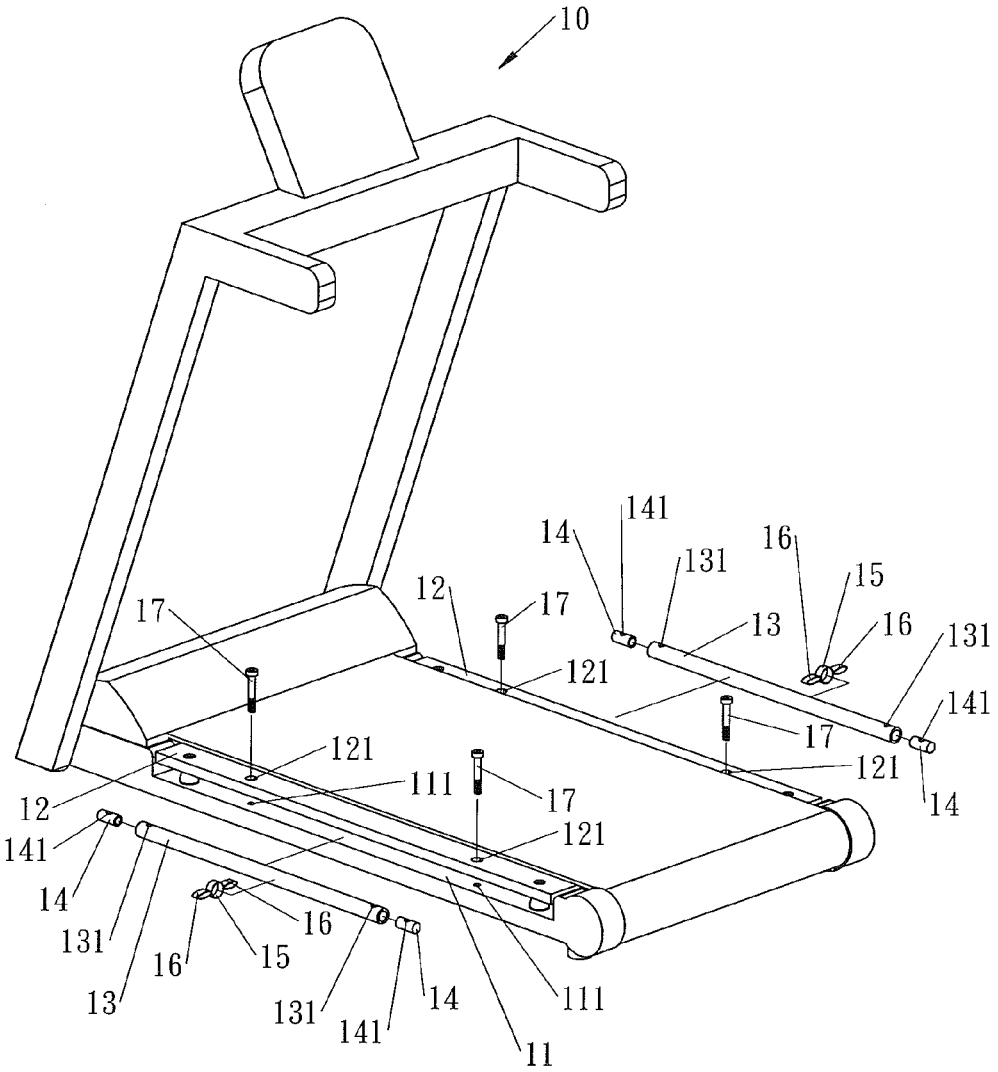
FIG. 5 is an exploded perspective view of the treadmill as shown in FIG. 4.
Figure 6:
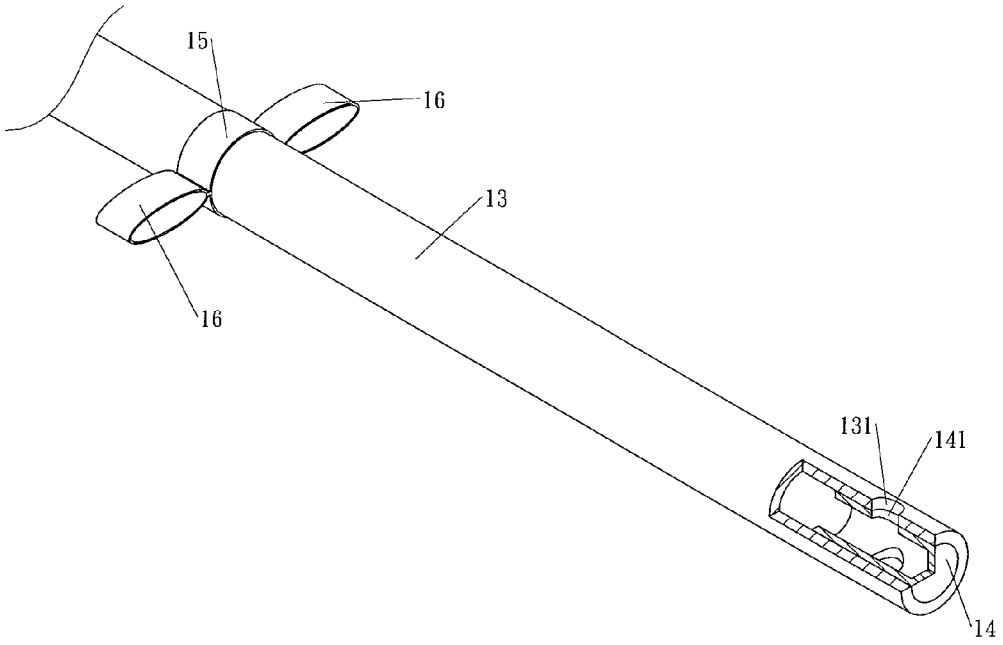
FIG. 6 is a partially enlarged perspective cross-sectional view of an elastic bar of the treadmill as shown in FIG. 5.
Figure 7:
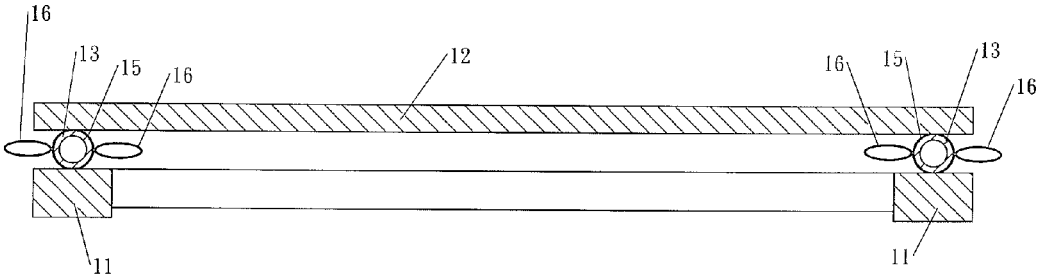
FIG. 7 is a side cross-sectional view of the treadmill as shown in FIG. 4.

Referring to the drawings and initially to FIGS. 4-7, a treadmill 10 in accordance with the preferred embodiment of the present invention comprises a frame 11, a support plate 12 mounted on the frame 11, and a shock-absorbing structure mounted on two opposite sides of the frame 11.

The shock-absorbing structure includes an elastic bar 13 mounted between the frame 11 and the support plate 12 to support the support plate 12 and to provide a shock-absorbing function, a mounting ring 15 mounted on the elastic bar 13, and two fixing sleeves 14 mounted on the elastic bar 13. The elastic bar 13 is located above the frame 11 and located under the support plate 12 and has two opposite ends each pivotally mounted between the frame 11 and the support plate 12. Thus, the elastic bar 13 is movable in a horizontal direction and is elastically bendable toward an inner side or an outer side of the support plate 12 to increase or decrease a contact area of the elastic bar 13 and the support plate 12 and to change a position of the elastic bar 13 relative to the support plate 12 so as to adjust a shock-absorbing effect of the support plate 12. Preferably, the elastic bar 13 is hollow. In the preferred embodiment of the present invention, the elastic bar 13 is made of rubber, silicon gel or polyurethane (PU). The mounting ring 15 is mounted on a mediate portion of the elastic bar 13 and is located between the fixing sleeves 14. The mounting ring 15 is provided with two pull tabs 16 which are directed toward two opposite directions. The pull tabs 16 are located at two opposite sides of the mounting ring 15. The fixing sleeves 14 are respectively mounted in the two opposite ends of the elastic bar 13.

In the preferred embodiment of the present invention, the support plate 12 has two opposite sides each provided with two first through holes 121, each of the two opposite ends of the elastic bar 13 is provided with a second through hole 131, each of the fixing sleeves 14 is provided with a third through hole 141, each of the two opposite sides of the frame 11 is provided with two fourth through holes 111, and the shock-absorbing structure further includes two pivot members 17 each extended through the respective first through hole 121 of the support plate 12, the respective second through hole 131 of the elastic bar 13, the third through hole 141 of the respective fixing sleeve 14 and the respective fourth through hole 111 of the frame 11, so that each of the two opposite ends of the elastic bar 13 is pivotally mounted between the frame 11 and the support plate 12.

Figure 8:
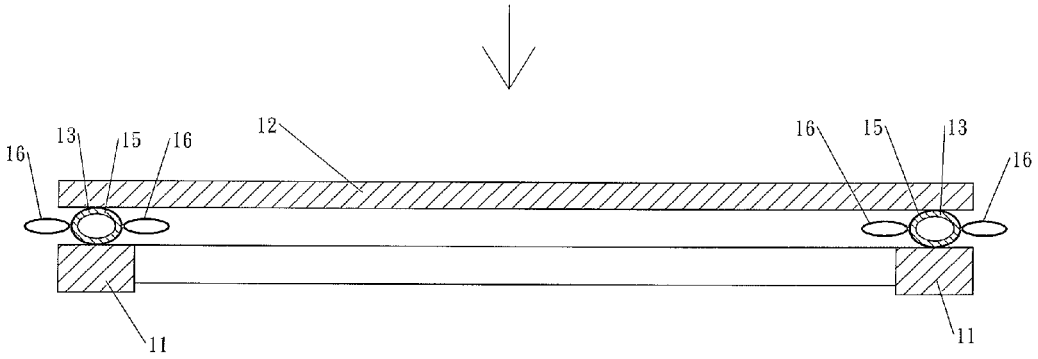
FIG. 8 is a schematic operational view of the treadmill as shown in FIG. 7 in use.
Figure 9:
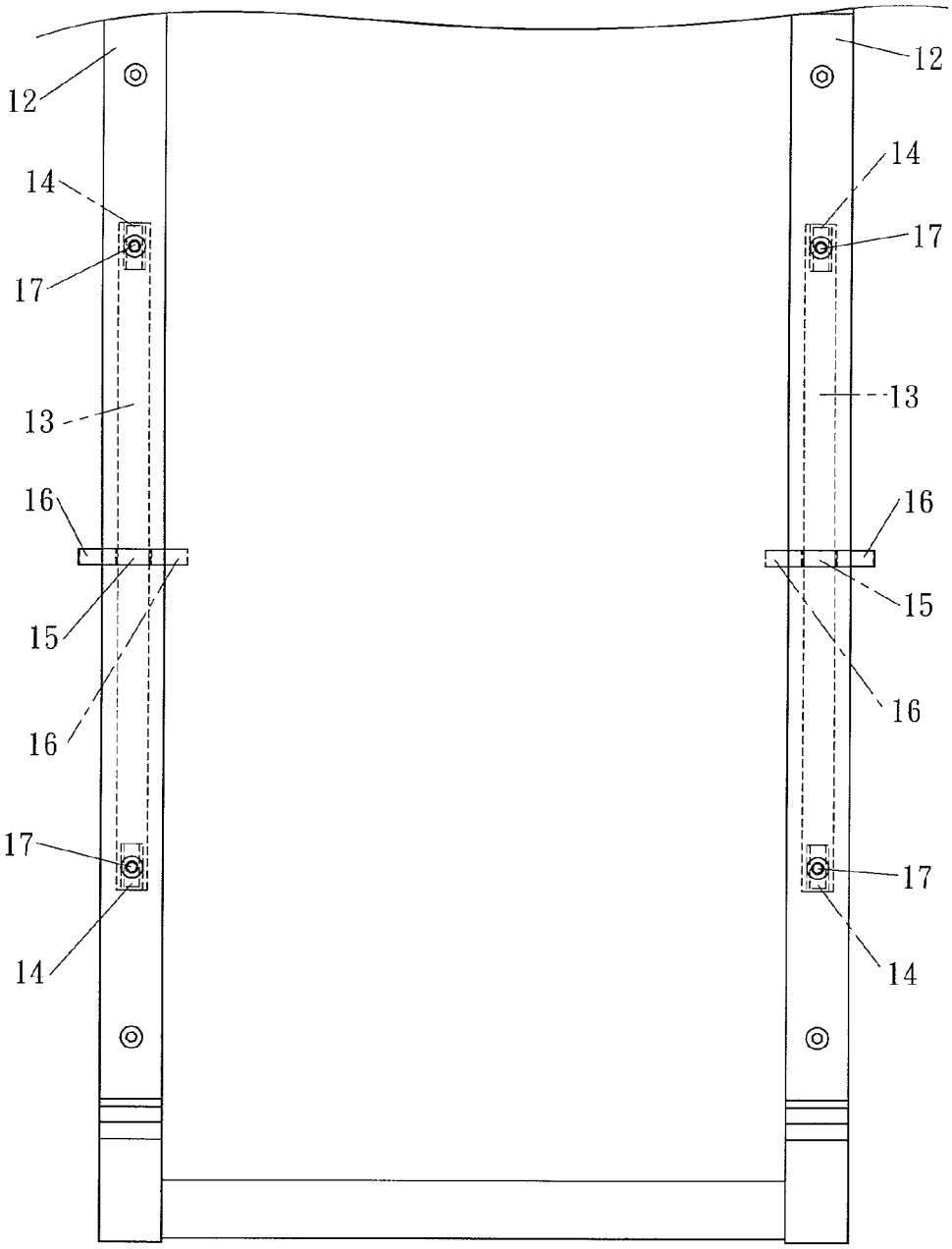
FIG. 9 is a partially top view of the treadmill as shown in FIG. 4.

In operation, referring to FIGS. 8-11 with reference to FIGS. 4-7, when the user steps on the support plate 12 of the treadmill 10, the support plate 12 is subjected to a downward force as shown in FIG. 8. At this time, the elastic bar 13 at the two opposite sides of the frame 11 is located under the support plate 12 to apply a reaction to the support plate 12 so as to provide a shock-absorbing function to the support plate 12.

Figure 10:
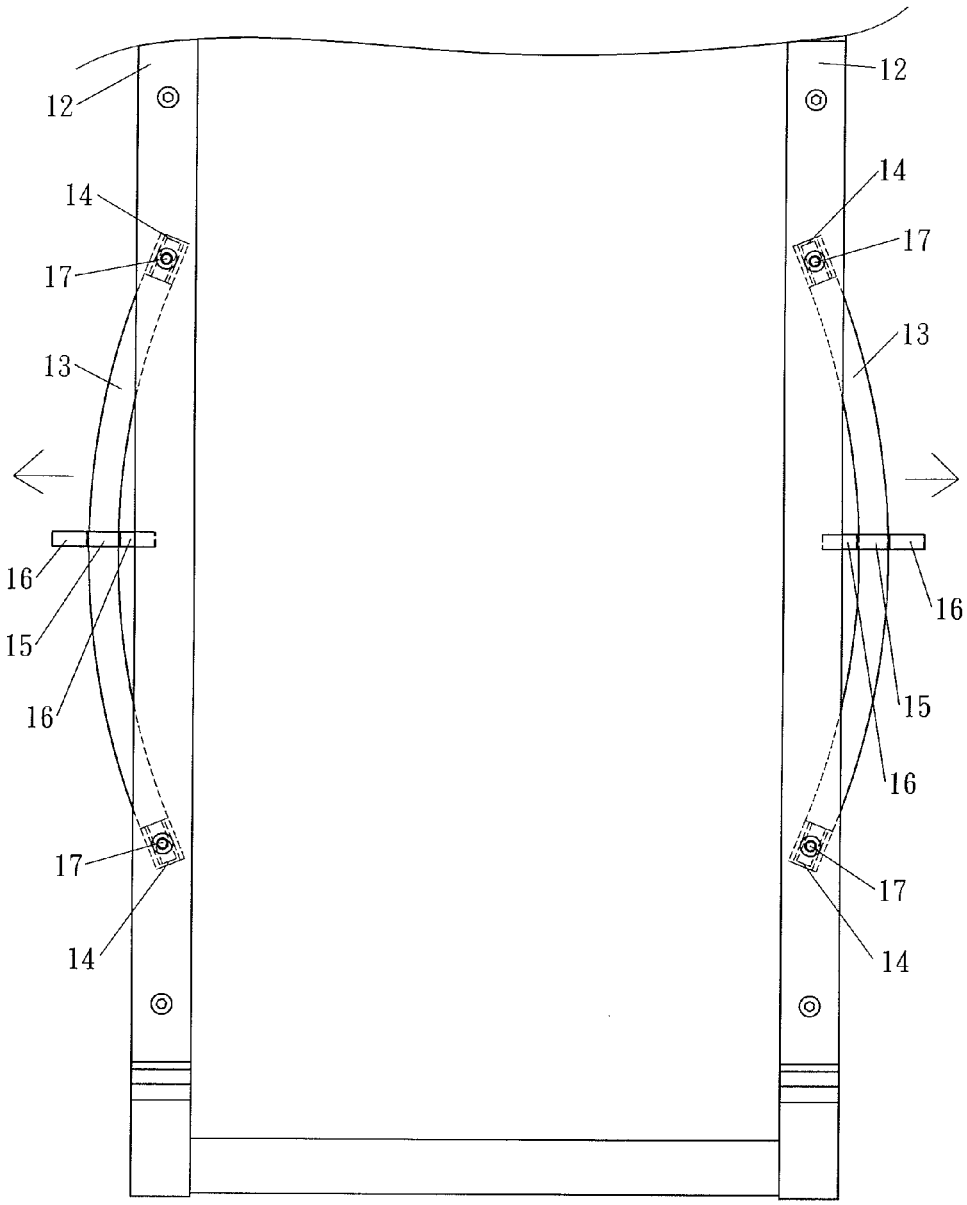
FIG. 10 is a schematic operational view of the treadmill as shown in FIG. 9 in adjustment.

In adjustment, when one of the two pull tabs 16 at the outer side of the mounting ring 15 is pulled, the elastic bar 13 at the two opposite sides of the frame 11 is pulled toward the outer side of the frame 11 to decrease the contact area of the elastic bar 13 and the support plate 12 and to move the elastic bar 13 to the position at the outer side of the support plate 12 as shown in FIG. 10. At this time, the elastic bar 13 is slightly exposed outward from the outer side of the frame 11. In such a manner, when the elastic bar 13 at the two opposite sides of the frame 11 is pulled toward the outer side of the frame 11, the contact area of the elastic bar 13 and the support plate 12 is decreased, so that the elastic bar 13 provides a smaller buffering force to the support plate 12 and is available for a user having a lighter weight. In addition, when the elastic bar 13 at the two opposite sides of the frame 11 is pulled toward the outer side of the frame 11, the elastic bar 13 is located at the outer side of the support plate 12, so that the elastic bar 13 applies a smaller reaction to the support plate 12, and the central portion of the support plate 12 is disposed at a softer state due to the decrease of reaction of the elastic bar 13.

Figure 11:
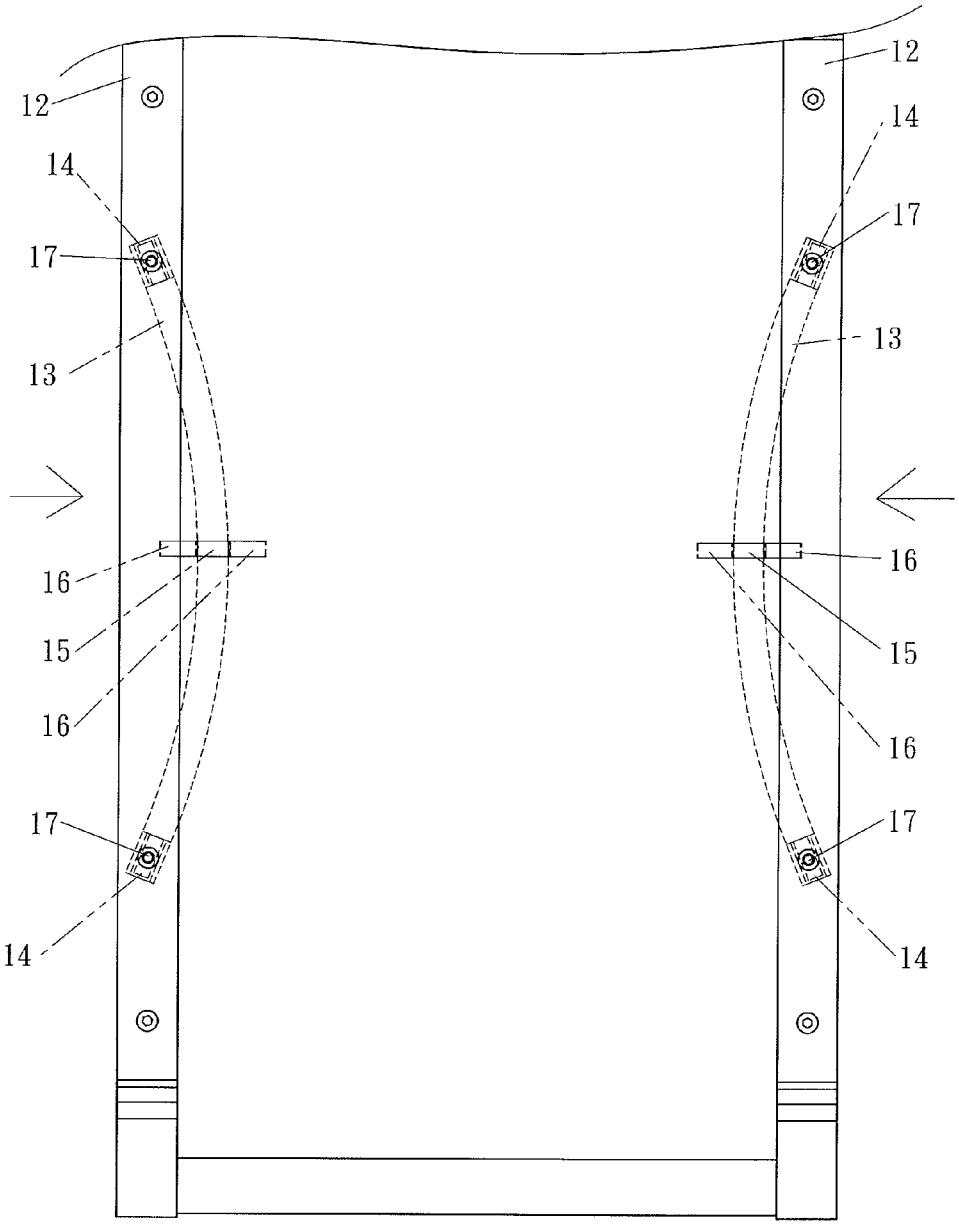
FIG. 11 is another schematic operational view of the treadmill as shown in FIG. 9 in adjustment.

On the contrary, when the other one of the two pull tabs 16 at the inner side of the mounting ring 15 is pulled, the elastic bar 13 at the two opposite sides of the frame 11 is pulled toward the inner side of the frame 11 to increase the contact area of the elastic bar 13 and the support plate 12 and to move the elastic bar 13 to the position at the inner side of the support plate 12 as shown in FIG. 11. At this time, the elastic bar 13 is slightly exposed outward from the inner side of the frame 11. In such a manner, when the elastic bar 13 at the two opposite sides of the frame 11 is pulled toward the inner side of the frame 11, the contact area of the elastic bar 13 and the support plate 12 is increased, so that the elastic bar 13 provides a larger buffering force to the support plate 12 and is available for a user having a heavier weight. In addition, when the elastic bar 13 at the two opposite sides of the frame 11 is pulled toward the inner side of the frame 11, the elastic bar 13 is located at the inner side of the support plate 12, so that the elastic bar 13 applies a larger reaction to the support plate 12, and the central portion of the support plate 12 is disposed at a harder state due to the increase of reaction of the elastic bar 13.

Accordingly, the contact area of the elastic bar 13 and the support plate 12 can be changed freely according to the requirement of users having different weights to adjust the reaction applied by the elastic bar 13 on the support plate 12, and to adjust the shock-absorbing function of the elastic bar 13. In addition, when the elastic bar 13 at the two opposite sides of the frame 11 is located at the outer side of the support plate 12, the central portion of the support plate 12 is disposed at a softer state, and when the elastic bar 13 at the two opposite sides of the frame 11 is located at the inner side of the support plate 12, the central portion of the support plate 12 is disposed at a harder state, so that the buffering function of the support plate 12 can be changed according to the user's requirement. Further, the elastic bar 13 is mounted between the frame 11 and the support plate 12 and is disposed at an exposed state so that the user can easily pull the pull tabs 16 at two opposite sides of the mounting ring 15 so as to change the contact area of the elastic bar 13 and the support plate 12 quickly and conveniently. Further, the two opposite ends of the elastic bar 13 are pivotally mounted between the frame 11 and the support plate 12, and the fixing sleeves 14 are respectively mounted in the two opposite ends of the elastic bar 13 to reinforce the structural strength of the two opposite ends of the elastic bar 13, thereby preventing the two opposite ends of the elastic bar 13 from being worn or torn due to repeatedly pulling actions during a long-term utilization.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A treadmill comprising:

a frame;

a support plate mounted on the frame; and a shock-absorbing structure mounted on two opposite sides of the frame;

wherein:

the shock-absorbing structure includes an elastic bar mounted between the frame and the support plate to support the support plate and to provide a shock-absorbing function;

the elastic bar is located above the frame and located under the support plate and has two opposite ends each pivotally mounted between the frame and the support plate;

the elastic bar is movable in a horizontal direction and is elastically bendable toward an inner side or an outer side of the support plate to increase or decrease a contact area of the elastic bar and the support plate and to change a position of the elastic bar relative to the support plate so as to adjust a shock-absorbing effect of the support plate.

2. The treadmill of claim 1, wherein the elastic bar is hollow.

3. The treadmill of claim 1, wherein the elastic bar is made of rubber, silicon gel or polyurethane (PU).

4. The treadmill of claim 1, wherein:

the shock-absorbing structure further includes a mounting ring mounted on the elastic bar;

the mounting ring is mounted on a mediate portion of the elastic bar; and the mounting ring is provided with two pull tabs which are directed toward two opposite directions.

5. The treadmill of claim 1, wherein:

the shock-absorbing structure further includes two fixing sleeves mounted on the elastic bar; and the fixing sleeves are respectively mounted in the two opposite ends of the elastic bar.

6. The treadmill of claim 5, wherein:

the support plate has two opposite sides each provided with two first through holes;

each of the two opposite ends of the elastic bar is provided with a second through hole;

each of the fixing sleeves is provided with a third through hole;

each of the two opposite sides of the frame is provided with two fourth through holes; and the shock-absorbing structure further includes two pivot members each extended through the respective first through hole of the support plate, the respective second through hole of the elastic bar, the third through hole of the respective fixing sleeve and the respective fourth through hole of the frame, so that each of the two opposite ends of the elastic bar is pivotally mounted between the frame and the support plate.

* * * * *